US007413192B1

(12) United States Patent
Van Buren

(10) Patent No.: US 7,413,192 B1
(45) Date of Patent: Aug. 19, 2008

(54) HIDE AND SEEK BOARD GAME

(76) Inventor: Timothy J. Van Buren, 3345 Stoney Creek Dr., Clayton, NC (US) 27520-5958

( * ) Notice: Subject to any disclaimer, the term of this patent is extended or adjusted under 35 U.S.C. 154(b) by 76 days.

(21) Appl. No.: 11/309,330

(22) Filed: Jul. 27, 2006

(51) Int. Cl.
*A63F 3/00* (2006.01)

(52) U.S. Cl. ..... 273/248; 273/262

(58) Field of Classification Search ..... 273/248, 273/262, 309; D21/334, 362
See application file for complete search history.

(56) References Cited

U.S. PATENT DOCUMENTS

| | | | | |
|---|---|---|---|---|
| 3,951,411 A | | 4/1976 | Hill et al. | 273/134 |
| 4,128,246 A | * | 12/1978 | Hicks et al. | 273/243 |
| 4,244,579 A | | 1/1981 | Campos | 273/243 |
| 4,323,248 A | * | 4/1982 | Zingale | 273/236 |
| 4,385,764 A | | 5/1983 | Bhatti | 273/243 |
| 5,104,127 A | | 4/1992 | Whitney | 273/243 |
| 5,118,113 A | | 6/1992 | Ahlers et al. | 273/243 |
| 5,139,268 A | * | 8/1992 | Garnett | 273/249 |
| 6,394,454 B1 | | 5/2002 | Etherington, Jr. et al. | 273/243 |
| 6,527,272 B1 | | 3/2003 | Conner | 273/243 |
| 6,669,197 B1 | | 12/2003 | Lund et al. | 273/243 |
| 6,719,289 B1 | * | 4/2004 | Brown et al. | 273/260 |
| 6,796,561 B2 | | 9/2004 | Bedford | 273/243 |
| 7,255,348 B1 | * | 8/2007 | Shaffer | 273/243 |

* cited by examiner

*Primary Examiner*—Vishu K. Mendiratta
(74) *Attorney, Agent, or Firm*—Ishman Law Firm P.C.

(57) ABSTRACT

A board game based on the popular child's outdoor game of hide and seek wherein players, as hiders, maneuver with respect to a primary hiding place and seek to reach the home base of a seeker. The board game includes a playing board configured in a circular path around a series of hiding places. Based on starting location, the players in response to random number generated moves and card instructions move through a proscribed path leading to the "safe" home base. Concurrently, the seeker moves to capture the hiders by landing on their occupied spaces. Certain of the spaces on the path require the drawing of a card which allows beneficial or detrimental moves for either the hider or the seeker, adding complexity to the mission of reaching the home base. The game continues in accordance with game rules until a hider reaches home base.

13 Claims, 3 Drawing Sheets

HIDE AND SEEK BOARD GAME

FIELD OF THE INVENTION

The present invention relates to board games and, in particular, to a seek and capture game based on the popular child's game of hide and seek.

BACKGROUND OF THE INVENTION

Board games of various types have been popular for ages with children and adults. Notwithstanding the classic and enduring board games, new board games continue to be developed providing variations around thematic premises. Games of capture wherein the game and rules focus on competitor moves to capture an objects have been disclosed in the prior art. Exemplary of such are the board games disclosed in U.S. Pat. Nos. 4,244,579 to Campos; 6,796,561 to Bedford; 3,951,411 to Hill; and 6,394,454 to Etherington.

SUMMARY OF THE INVENTION

The present invention provides a capture board game based on the popular child's outdoor game of hide and seek. Herein, the players, as hiders, maneuver with respect to primary hiding places and seek to reach the home base of the seeker. The board game includes a playing board configured in a circular path around a series of hiding places. Based on starting location, the players in response to random number generated moves and card instructions move through a proscribed path leading to the "safe" home base. Concurrently, the seeker moves to capture or tag the hiders by landing on their occupied spaces. Certain of the spaces on the path require the drawing of a card which dictates beneficial or detrimental moves for either the hider or the seeker, adding complexity to the mission of reaching the home base. The game continues in accordance with game rules until a hider reaches home base.

Accordingly, it is an object of the present invention to provide a board game based on the child's game of hide and seek.

Another object is to provide a capture board game wherein the hiding player is provided with options for avoiding capture.

A further object is to provide a hide and seek board game for a plurality of players wherein a hiding player may experience voluntary and involuntary choices in eluding capture before reaching a winning position.

BRIEF DESCRIPTION OF THE DRAWINGS

The above and other features of the invention will become apparent upon reading the following description taken in conjunction with the accompanying drawing in which.

DETAILED DESCRIPTION OF THE PREFERRED EMBODIMENT

Figure 1:
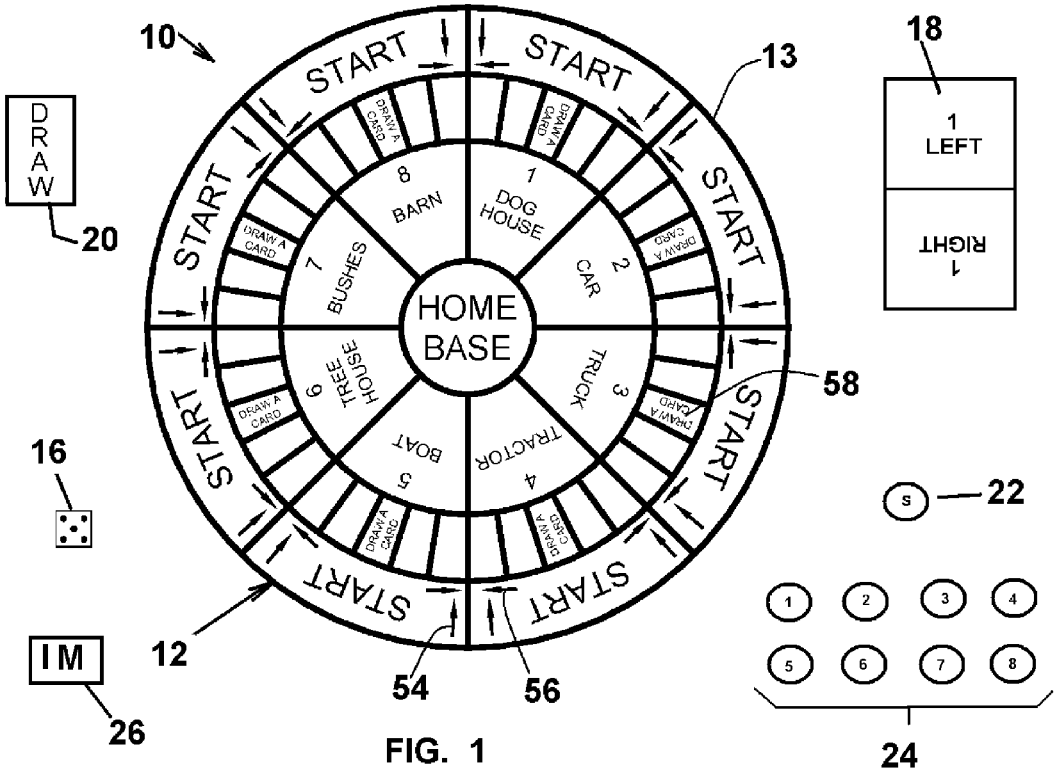
FIG. 1 is a plan view of the board game according to an embodiment of the invention.

Referring to the drawing for the purposes of describing the preferred embodiment and not for limiting same, FIG. 1 illustrates a board game 10 based on hide and seek and includes a game board 12 having a circular playing field 13, and attendant game articles including a random number generators in the form of a die 16, direction cards 18, draw cards 20 and game pieces including a hider 22 and eight seekers 24, and an instruction manual 26.

Figure 2:
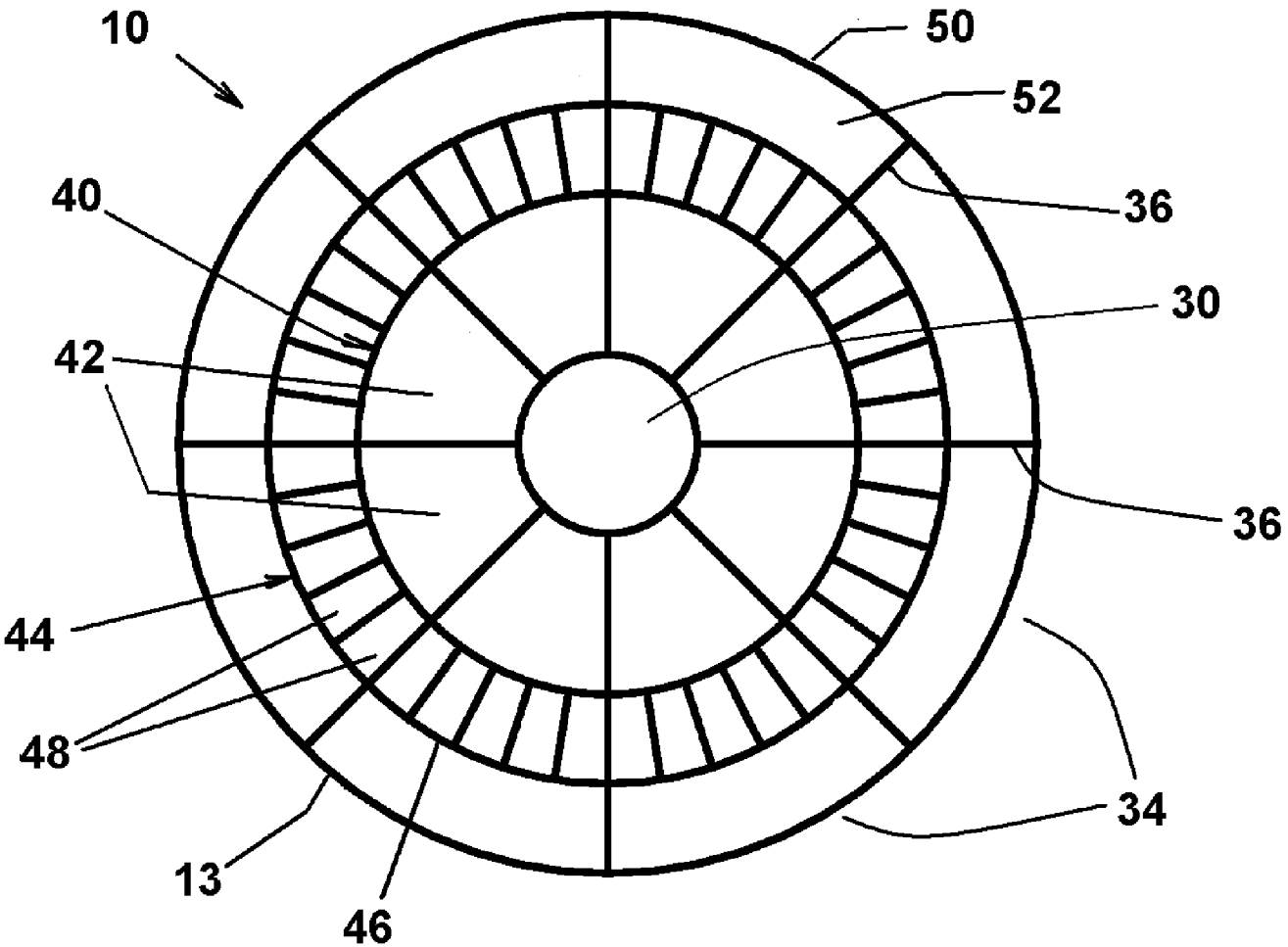
FIG. 2 is a plan view of the game board without printed indicia.

The design of the game board 12 is imprinted on a suitable substrate, circular or rectangular preferred, and may provide for folding storage. Referring to FIG. 2 wherein the playing field 13 for clarity is shown without printed and instructional indicia, the playing field 13 of the game board 12 includes a circular "home base" or center ring 30, from which eight radial sectors 34 are delineated by eight radial lines 36. Disposed about the center ring 30 are an inner concentric annular ring 40, divided into eight hiding places or sub-sectors 42, a middle concentric annular ring 44 constituting a player movement circuit comprised of the eight radial subsectors 46, each having five sector positions 48, and an outer concentric annular ring 50 divided into eight starting sectors 52.

Returning to FIG. 1, the center ring 30 is labeled "home base". The subsectors 42 are transitional areas to home base. The subsectors 42 are labeled numerically and with names of descriptive hiding places as illustrated. The starting sectors 52 are labeled "Start" and include sets of radial arrows 54 and tangential arrows 56 at each end. The center sector position 58 of each subsector 46 is labeled with "Draw a Card".

The die 16 is conventional with the six faces appropriately marked. The die is rolled by a player with the upper face randomly generating an indicative number. Other random number generators may be used such as a spinner wheel wherein an arrow is spun and the number determined by a number sector in which the arrow tip comes to rest.

The direction cards 18 are provided in a pack, one for each player. One side of each card is blank or provided with a common indicia, such as game name. The other side is longitudinally divided, with one half bearing the word and/or number of a hiding place and labeled "left" and the other half side bearing the word and/or number of the card and labeled "right". A card is provided for each hiding place and for the seeker.

The draw cards 20 are provided in a pack with each card bearing an instruction. For purpose of the embodiment, the instructions include; a return card, "Go back to Start"; a loss card, "Lose a Turn"; a trading card, "Trade Places with Hider"; a move card, "Move Forward (Numerical) Spaces"; a pass card, "Free Pass"; and a safe card, "Safe When Seeker Lands on Your Space". The draw cards 20 provide various instructions by which the drawing player may complicate capture. The cards may be included in multiples and/or with other variations of the instructions.

The seeker 22 is in the form of a game piece, with a color and/or shape distinguished from the hiders 24. Similarly, the hiders are in the form of game piece, with colors and/or shapes, distinctive as to other hiders and as to the seeker.

Figure 3:
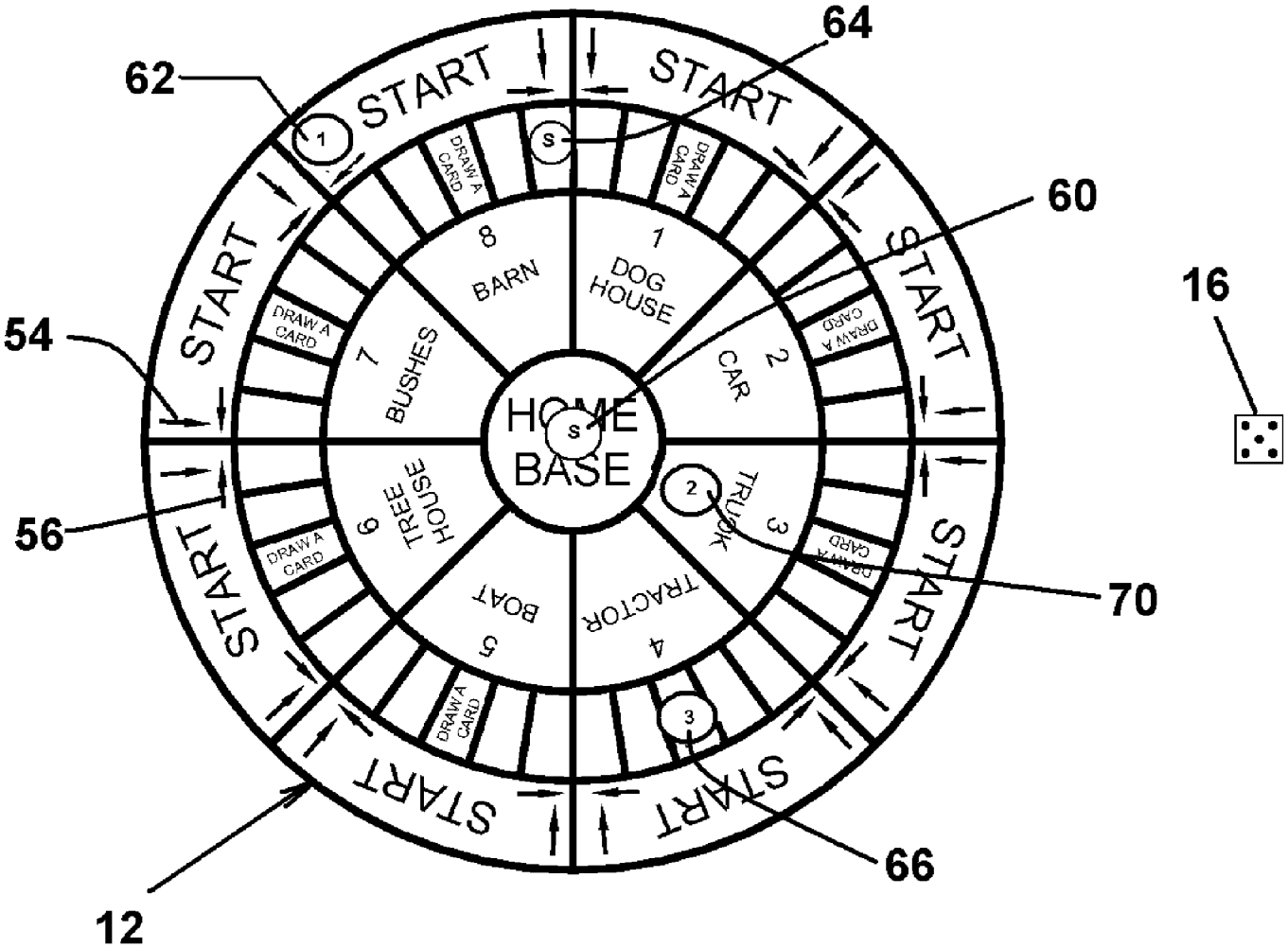
FIG. 3 is a plan view of the game board illustrating certain playing conditions.

The instruction manual 26 includes the instructions and rules for play the game as set forth in Example 1, below and with reference to FIG. 3.

Example 1

The Game

Game Contents

The hide and seek board game 10 is provided in a suitable package and contains: a game board 12, an instruction manual 26, one die 16, nine direction cards 18, a pack of draw cards 20; one seeker piece 22, and eight hider pieces 24.

Playing the Game

Object

For a hider to move from a starting hiding location to home base without being captured or tagged by the seeker.

Starting the Game

The game is started by selecting a seeker. Preferably, this is by dealing the direction cards to the players. All cards are dealt to the player. In games with smaller numbers of players, players may be dealt more than one card. The player receiving the seeker card becomes the seeker. The other players become hides at the hiding place referenced on the card. If a hider is dealt more than one card, they may choose their hiding place for the game. Alternatively, the seeker and hiders may be selected arbitrarily, voluntarily, or by use of a random generator.

The seeker then places a seeker game piece in the home base as indicated by marker 60. The hiders select a starting direction by displaying their direction card in their chosen direction of movement and locate their markers at their designated hiding place. Each player must maintain the chosen direction of movement until returning to their starting location, at which time the direction of future movement may be changed. An exemplary starting position is shown by marker 62.

Playing the Game

Play is commenced by the first numbered player and numerically continued with the seeker being the last to player to roll. Each hider rolls the die and moves accordingly in their chosen direction. The objective is for the hider to complete a continuous circuit by returning to their starting location and into a transition area with an exact roll, and to reach home base from that location by rolling a discrete die number, preferably one. A hider cannot be captured in a transition area. The seeker rolls last and moves from home base to the starting location for one of the hiding places as indicated by marker 64. If the seeker lands on the same location as one of the hiders, that hider and seeker switch entities and return to their respective starting positions.

Absent the drawing cards and special rules, the game continues until a hider reaches home base.

Rules

1. Two or more hiders may occupy a common space.

2. If two or more hiders are on a common space and the seeker lands on that space, each player rolls the die. The lowest number will then be the seeker, and the others will be hiders and return to their original starting positions. If a seeker lands on a common space with one hider, the players switch entities, i.e. the hider becomes the seeker and the seeker becomes the hider, and return to their respective starting positions.

3. When the seeker rolls a six, the seeker may either advance six places or return to home base.

4. When a player lands on a draw card space as indicated by market 66, a draw card is drawn from the pack. If a "Go Back to Start" card is drawn, the player returns to their starting position and the card is returned. If a "Lose a Turn" card is drawn, the player loses the next movement opportunity, and the card is returned. If a "Trade Places with Hider" card is drawn, the hider may exchange places with a hider of their choice, and the card is returned. If a "Move Forward 4. Spaces" card is drawn, the player moves accordingly, and the card is returned. If a "Free Pass" card is drawn, the player retains the card, and is a seeker lands on their spot, the hider uses the card to avoid capture and return the seeker to their starting space, and the card is returned. If a "Safe When Seeker Lands on your Space" card is drawn, the player may use to card when the seeker lands on their space to avoid capture, and the card is returned.

5. A hider must reach the safe area of their hiding location with an exact roll. If a greater number is rolled, the player loses the turn.

6. A hider must roll a discrete number to move from the safe area to home base, preferably a "1". A hider cannot move to home base, if home base is occupied by the seeker.

Winning the Game

Subject to these rules, play continues until a hider is completes a circuit on the board returning to their starting space and reach their transition safe spot in their hiding location on an exact roll, as indicated by marker 70. After reaching the safe spot, the hider must roll a "1" to enter home base. They cannot home base if it is occupied by the seeker. If they enter home base when it is vacant, they successfully complete their objective and win the game. Play may continue, if desired, until each hider is "safe".

It will thus be appreciated the present game incorporates the essence of the traditional hide and seek game, while introducing variants and complexities making the task of safely arriving at home base more difficult, adding to the enjoyment of the players.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claims.

What is claimed is:

1. A hide and seek board game for a plurality of players, comprising:

a planar game board, said game board including a playing field having a circular outer path of movement spaces surrounding and outwardly spaced from an inner home area and divided into a plurality of evenly circumferentially spaced sectors of consecutive movement spaces a designated hiding space on said board connecting each of said sectors with said home area;

a direction card for each of said hiding spaces, said direction card bearing a designation of the hiding place and having a first section indicating movement in one direction and a second section indicating said movement in an opposite direction;

a start area on said board surrounding each sector adapted to hold a direction card associated with the hiding space connected with such sector, said start area having first and second ends, said first end having one arrow indicating movement on said path in one direction and another arrow indicating movement to said hiding space connected with such sector, said second end having one arrow indicating movement on said path in an opposite direction to said one directing and another arrow indicating movement to said hiding space connected with such sector;

a seeker player piece originally placed at said home area at a seeker starting position;

a plurality of hider player pieces, each hider player piece having a form distinctive from other hider player pieces and said seeker player piece;

a random number generator operable for prescribing movement of said player pieces;

a draw space in each of said sectors;

a plurality of draw cards each having written instructions designating actions to be undertaken; and a manual of rules having written instructions governing movement of said player pieces and enabling continuation of the game until a hider player piece reaches said home area.

2. The board game as recited in claim 1 wherein said manual directs that a hider player is captured by said seeker player occupying a common movement space therewith whereat said players reverse entity and return to designated starting positions.

3. The board game as recited in claim 2 wherein said manual directs that said hider player is not captured if another hider player is also on said common movement space.

4. The board game as recited in claim 1 wherein said manual directs that a hider player may move a transition area and completing a continuous circuit from said starting point.

5. The board game as recited in claim 4 wherein said manual directs that a hider player may move from said transition area to said home area by generating a discrete number at said random number generator.

6. The board game as recited in claim 5 wherein said random number generator is a die.

7. The board game as recited in claim 1 wherein one of said written instructions on a draw card returns the holder thereof to its respective starting position.

8. The board game as recited in claim 7 wherein one of said written instructions on a draw card enables said hider player to avoid said capture.

9. The board game as recited in claim 8 wherein one of said draw instructions on a draw card causes the player to lose an opportunity to move.

10. The board game as recited in claim 9 wherein one of said written instructions on a draw card instructs the player to move a specified number of spaces.

11. The board game as recited in claim 10 wherein one of said written instructions on a draw card enables said hider player to avoid said capture.

12. The board game as recited in claim 11 wherein said manual directs that said seeker player is returned to said home area by generating a discrete number at said random generating means.

13. The board game as recited in claim 1 wherein said random number generator is selected from the group consisting of at least one die and a spinning device.

* * * * *